US009158245B2

(12) United States Patent
Sakai et al.

(10) Patent No.: US 9,158,245 B2
(45) Date of Patent: Oct. 13, 2015

(54) MEDIUM TRANSPORTING APPARATUS AND IMAGE FORMING APPARATUS

(71) Applicant: Oki Data Corporation, Tokyo (JP)

(72) Inventors: Masato Sakai, Tokyo (JP); Teruaki Kuroda, Tokyo (JP); Keita Ishimori, Tokyo (JP)

(73) Assignee: OKI DATA CORPORATION, Tokyo (JP)

( * ) Notice: Subject to any disclaimer, the term of this patent is extended or adjusted under 35 U.S.C. 154(b) by 187 days.

(21) Appl. No.: 13/721,387

(22) Filed: Dec. 20, 2012

(65) Prior Publication Data

US 2013/0183069 A1 Jul. 18, 2013

(30) Foreign Application Priority Data

Jan. 13, 2012 (JP) ..... 2012-005686

(51) Int. Cl.

| | |
|---|---|
| ***G03G 15/20*** | (2006.01) |
| ***B65H 29/52*** | (2006.01) |
| ***G03G 15/00*** | (2006.01) |
| ***B65H 5/26*** | (2006.01) |

(52) U.S. Cl.

CPC ..... *G03G 15/2028* (2013.01); *B65H 5/26* (2013.01); *B65H 29/52* (2013.01); *G03G 15/6573* (2013.01); *B65H 2404/513* (2013.01); *B65H 2404/5214* (2013.01); *B65H 2404/61* (2013.01); *G03G 2215/00417* (2013.01); *G03G 2215/00421* (2013.01)

(58) Field of Classification Search

CPC ..... G03G 15/2028; G03G 2215/00421; G03G 2215/00417

USPC ..... 399/322, 405; 271/225

See application file for complete search history.

(56) References Cited

U.S. PATENT DOCUMENTS

| | | | | |
|---|---|---|---|---|
| 6,298,214 | B1 * | 10/2001 | Koga | 399/322 |
| 2005/0201795 | A1 | 9/2005 | Kawachi et al. | |
| 2009/0245906 | A1 | 10/2009 | Jeong et al. | |
| 2010/0327510 | A1 | 12/2010 | Matsuno et al. | |

FOREIGN PATENT DOCUMENTS

| | | | | |
|---|---|---|---|---|
| EP | 0 230 313 | A2 | | 7/1987 |
| JP | 62-120755 | | | 7/1987 |
| JP | H04-189237 | A | | 7/1992 |
| JP | 11-095587 | A | | 4/1999 |
| JP | 2003192180 | A | * | 7/2003 |
| JP | 2008-094550 | | | 4/2008 |
| JP | 2008094550 | A | * | 4/2008 |
| JP | 2008-189393 | | | 8/2008 |
| JP | 2008189393 | A | * | 8/2008 |
| JP | 2010-247982 | | | 11/2010 |
| JP | 2010247982 | A | * | 11/2010 |

* cited by examiner

*Primary Examiner* — David Gray
*Assistant Examiner* — Tyler Hardman
(74) *Attorney, Agent, or Firm* — Rabin & Berdo, P.C.

(57) ABSTRACT

A medium transporting apparatus includes a first transporting section and first guide. The first transporting section transports a medium.

The first guide guides the medium transported by the transporting section, and is disposed downstream of the first transporting section with respect to a first direction in which the medium is transported. The first guide includes a first guide portion and a second guide portion. The first guide portion extends in the first direction. The second guide portion extends in a second direction substantially perpendicular to the first direction.

16 Claims, 8 Drawing Sheets

MEDIUM TRANSPORTING APPARATUS AND IMAGE FORMING APPARATUS

BACKGROUND OF THE INVENTION

1. Field of the Invention

The present invention relates to a medium transporting apparatus that transports a medium and an image forming apparatus that incorporates the medium transporting apparatus.

2. Description of the Related Art

Japanese Patent Publication No. 11-95587 discloses a conventional medium transporting apparatus and an image forming apparatus that incorporate a transporting guide for guiding a medium through a transport path.

The conventional apparatuses can cause the medium to be rubbed or scratched by the guide surface when the medium is pressed against the guide surface of the transporting guide.

SUMMARY OF THE INVENTION

The present invention was made to solve the aforementioned drawbacks of conventional apparatuses.

An object of the invention is to provide a medium transporting apparatus and an image forming apparatus in which the rubbing of a medium against the surface of a guide member is minimized.

A medium transporting apparatus includes a first transporting section and first guide. The first transporting section transports a medium.

The first guide guides the medium transported by the transporting section, and is disposed downstream of the first transporting section with respect to a first direction in which the medium is transported. The first guide includes a first guide portion and a second guide portion. The first guide portion extends in the first direction. The second guide portion extends in a second direction substantially perpendicular to the first direction.

Further scope of applicability of the present invention will become apparent from the detailed description given hereinafter. However, it should be understood that the detailed description and specific examples, while indicating preferred embodiments of the invention, are given byway of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given byway of illustration only, and thus are not limiting the present invention, and wherein.

DETAILED DESCRIPTION OF THE INVENTION

Embodiments of a medium transporting apparatus and an image forming apparatus according to the present invention will be described with reference to the accompanying drawings.

First Embodiment

Figure 1:
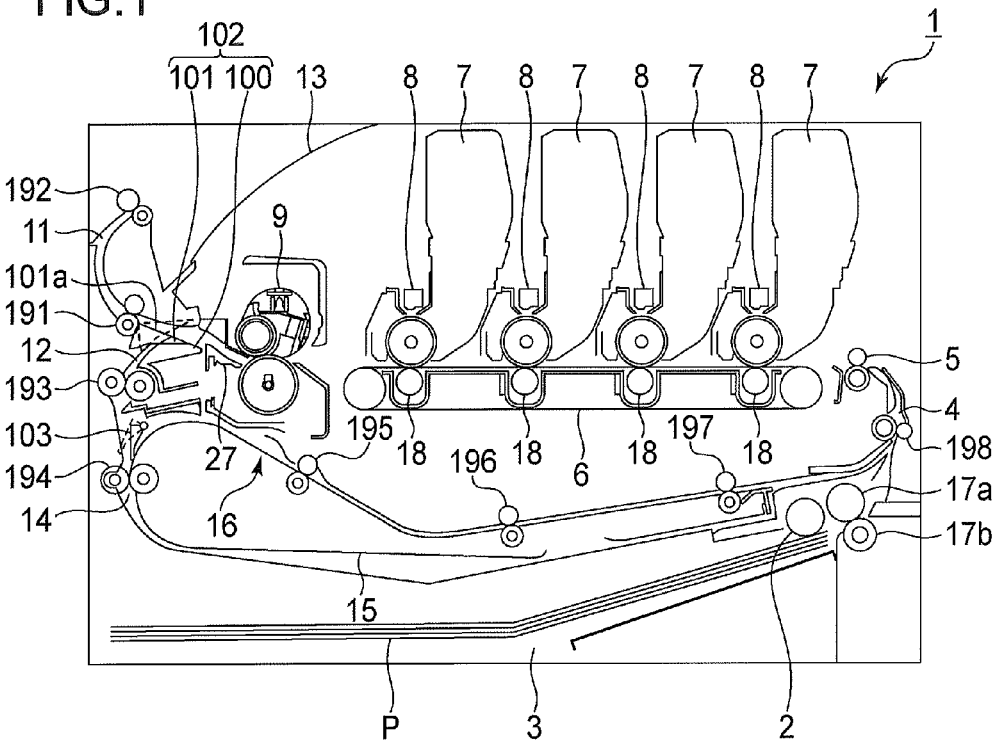
FIG. 1 illustrates the configuration of an image forming apparatus according to a first embodiment.

FIG. 1 illustrates the configuration of an image forming apparatus according to a first embodiment.

A cassette 3 is disposed at a lower part of a printer 1 as an image forming apparatus, and holds a stack of medium P on which an image is to be printed. A pick-up roller 2 feeds the medium P towards a transport path located at an upper right shoulder of the cassette 3.

A feed roller 17*a* and a retard roller 17*b* are located immediately downstream of the cassette 3 with respect to the direction in which the medium P is transported, and cooperate with each other to feed the medium P on a sheet-by-sheet basis into the transport path 4, so that the medium P is transported through the transport path 4 disposed downstream of the feed roller 17*a* and retard roller 17*b*.

The medium P is transported in a vertical direction shown in FIG. 1 through the transport path 4 to a registry roller 5. An endless transfer belt 6 is located downstream of the registry roller 5, at a middle portion of the printer 1. The transfer belt 6 is disposed about a plurality of rollers, and is driven by a drive source (not shown) to run counterclockwise, i.e., in such a direction as to transport the medium P from the registry roller 5 to a fixing section 9.

Four print engines 7 are disposed over and along the transfer belt 6, and are arranged in tandem from upstream to downstream of the transport path 4. Transfer rollers 18 are disposed in correspondence with the print engines 7 with the transfer belt 6 sandwiched between the print engines 7 and the transfer rollers 18. Four light emitting diode (LED) heads 8 are disposed in correspondence with the four print engines 7. Each LED head 8 selectively illuminates the charged surface of a photoconductive body of a corresponding print engine 7 in accordance with image data received from a printing controller (not shown), so that the print engine 7 produces a toner image.

The registry roller 5 feeds the medium P onto the transfer belt 6 in synchronism with the electrophotographic process performed by the print engines 7. The medium P passes through the four print engines 7 in sequence so that the toner images of corresponding colors are transferred by the corresponding transfer rollers 18 onto the medium P one over the other in registration. The fixing section 9 is located downstream of the transfer belt 6. The medium having a full-color toner image thereon passes through a fixing point defined between a heat roller and a pressure roller in the fixing section 9, so that the full-color toner image is fixed.

A route selector 102 is located between a transport roller pair 191 and a guide 27 as a first guide, and selects a route for the medium P to advance after the medium P has passed the fixing section 9. The route selector 102 as a second guide guides the medium P either to the transport roller pair 191 or to a transport roller pair 193. The route selector 102 includes a guide 100 that guide the medium P and a router 101. The guide 100 is in the shape of a comb. The guide 27 as a first guide, transport roller pair 191, route selector as a second guide 102 constitute a medium transporting apparatus of the invention.

The router 101 is disposed downstream of the guide 27, and is configured to switch the direction in which the medium P should be transported. The router 101 is also in the shape of a comb, so that the router 101 is movable into and out of an interdigitated engagement with the guide 100. The router 101 is switched by a drive source (not shown) between a dotted-line position thereof and a solid-line position thereof. When the router 101 is positioned at the solid-line position, the router 101 is in the interdigitated engagement with the guide 100, so that the medium P is routed into a discharge path 11 located downstream of the transport roller pair 191, so that the discharge roller pairs 191 and 192 discharge the medium P onto a stacker 13 through the discharge path (simplex path).

When the router 101 is positioned at the dotted-line position, the router 101 is out of the interdigitated engagement with the guide 100. With the router 101 at the dotted-line position, if another router 103 is positioned at a solid-line position thereof, the medium P is routed into an inverter 12 disposed downstream of the router 101, so that the transport roller pairs 193 and a transport roller pair 194, driven by a derive source (not shown), transport the medium P to enter a duplex tray 15 partly. The transport roller pair 194 is then driven to rotate in the opposite direction with the router 103 remaining at a dotted-line position, so that the medium P is transported from the duplex tray 15 into a duplex return path 16. Then, the medium P is transported by transport roller pairs 195, 196, 197, and 198.

Figure 7:
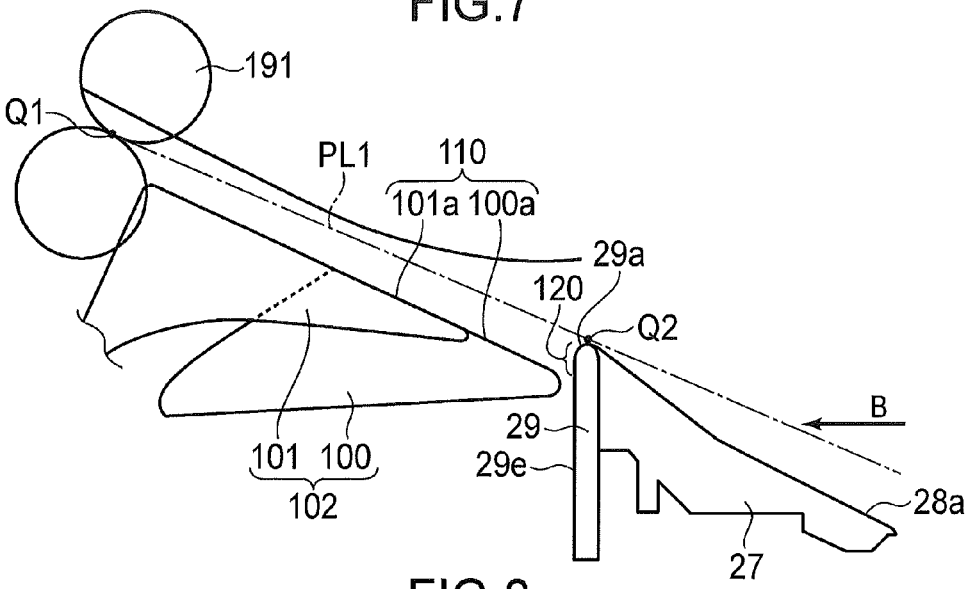
FIG. 7 illustrates a step 120 between the guide surface and an upstream end of the guide surface.

When simplex printing is performed, a toner image is transferred onto one side of the medium P and the medium P is then discharged onto the stacker 13 through the discharge path 11 or simplex path (FIG. 7). When duplex printing is performed, a toner image is transferred onto one side of the medium P, and the medium P is then transported through the duplex return path 16, and then transported to the most upstream print engine for printing on the other side of the medium P. The medium P passes through the four print engines 7. The medium P is then discharged through the simplex path (first path) onto the stacker 13. The guide 27 is disposed immediately downstream of the fixing section 9. A discharge roller pair 191 as a second transporting section is disposed downstream of the guide 27.

Figure 2:
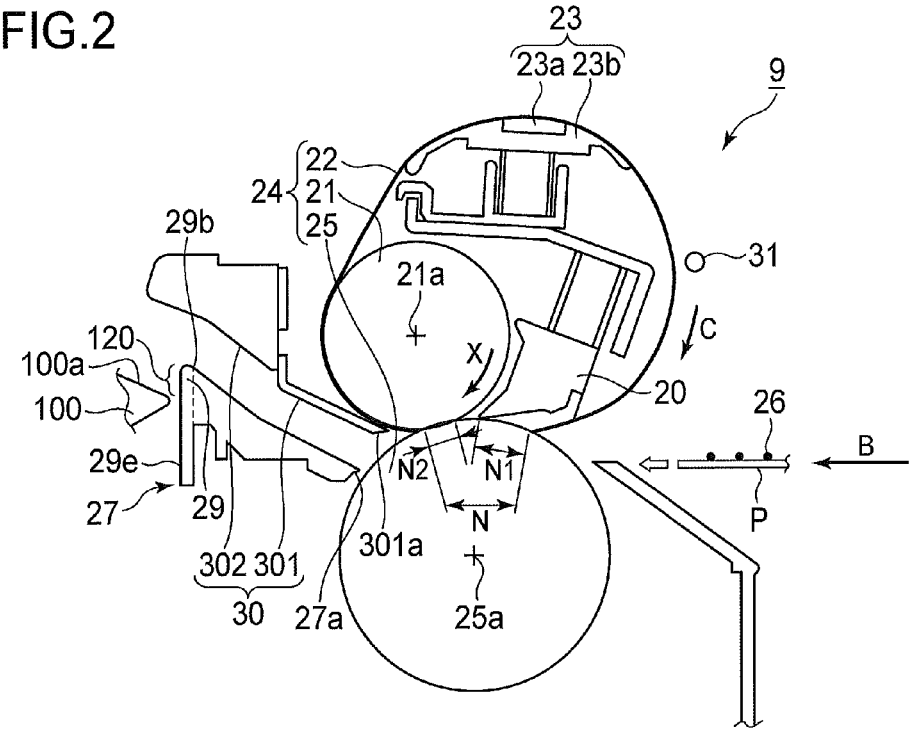
FIG. 2 is a cross-sectional view illustrating the configuration of a fixing section.

FIG. 2 is a cross-sectional view illustrating the configuration of the fixing section 9.

A fixing belt 22 is disposed about a fixing roller 21, a fixing pad 20, and a heating member 23, and revolves in a direction shown by arrow C to transport the medium P. The fixing belt 22 is sandwiched between the fixing roller 21 and a pressure roller 25, so that a first nip N1 is formed between the fixing roller 21 and the pressure roller 25 and a second nip N2 is formed between the fixing pad 20 and the pressure roller 25. The heating member 23 includes a flat heater 23*a* that heats the fixing belt 22 from inside via the heating member 23. A temperature detector 31 detects the temperature of the fixing belt 22 and a controller (not shown) performs a control operation to maintain the temperature of the fixing belt 22 to a predetermined value.

The fixing roller 21 is driven by a drive source (not shown) to rotate in a direction shown by arrow X, and transmits the rotation thereof to the pressure roller 25 via the fixing belt 22, so that the pressure roller 25 is also driven by the fixing roller 21 to rotate. Thus, the medium P is pulled in between the fixing belt 22 and the pressure roller 25, and the toner image on the medium P is fixed by heat and pressure and then the medium P is transported further downstream. The fixing roller 21, fixing belt 22 and pressure roller 25 form a first transport section 24.

The guide 27 is located downstream of a first nip N1 formed between the fixing roller 21 and the pressure roller 25. The guide 27 has a separator 27*a* located in the vicinity of the longitudinal end of the fixing roller 21 and pressure roller 25. The separator 27*a* prevents the medium P from becoming tacked to the pressure roller 25 shortly after the medium has passed the first nip N1 and a second nip N2. In other words, the free end 27*a* of the guide 27 enters a gap between the leading edge of the medium P and the pressure roller 25, thereby preventing the medium P from wrapping around the pressure roller 25. The guide 27 also includes a guide rib 29 that extends in a direction shown by arrow A (FIGS. 3 and 5) substantially perpendicular to a direction shown by arrow B in which the medium P is transported.

A guide 30 as a third guide is disposed over the guide 27, and faces the guide 27 to define a transport path between the guide 30 and the guide 27. The guide 30 includes a guide member 301 and a guide member 302. A separator 301*a* is positioned at an upstream end portion of the guide 30 and functions to separate the medium P from the fixing belt 22 so that the print medium P does not become tacked to the fixing belt 22. The medium P is pulled in between the guide 30 and the guide 27 with the toner image that should be fixed facing upward as shown in FIG. 2.

Figure 3:
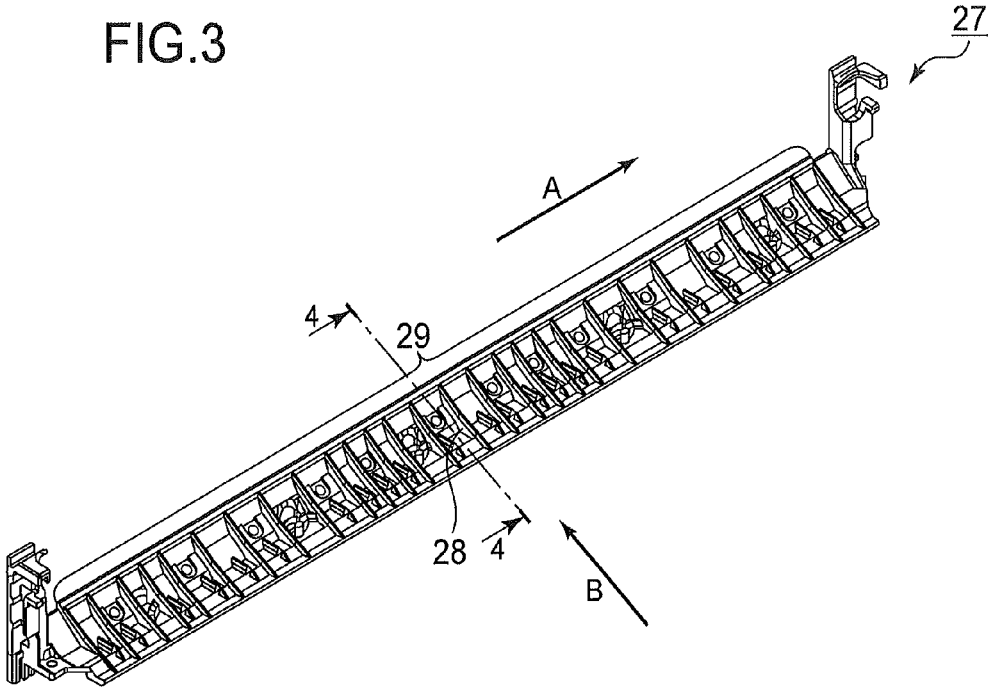
FIG. 3 is a perspective view of a guide.

FIG. 3 is a perspective view of the guide 27. The guide 27 includes a plurality of guide ribs 28 that extend substantially in the B direction. The guide 27 also includes a guide rib 29 that extends in the A direction substantially perpendicular to the B direction in which the medium P is transported. The term substantially perpendicular direction covers angles in the range of 85-95 degrees.

Figure 4:
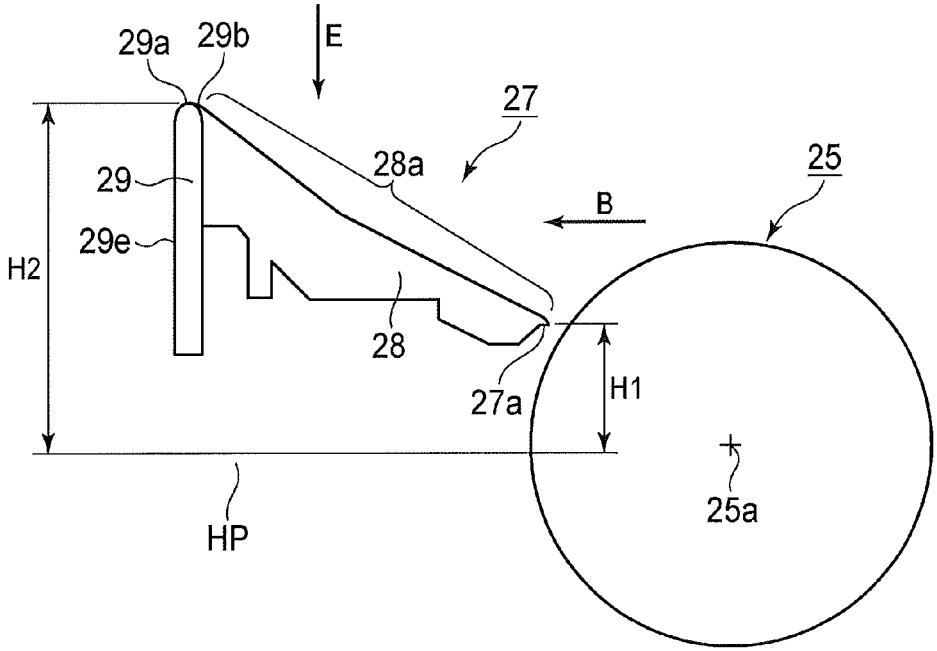
FIG. 4 is a cross-sectional view taken along a line 4-4 in FIG. 3.

FIG. 4 is a cross-sectional view taken along a line 4-4 in FIG. 3. The guide rib 28 has a guide surface 28*a* that guides the medium P when the medium P is guided by the guide 27. The guide surface 28*a* is inclined so that when the medium P advances on the guide 27 in the B direction, the medium P slides upward on the guide surface 28*a*. It is preferable that at least three guide ribs 28 are aligned in the A direction to ensure stable, reliable transport of the medium P. The upstream end of the guide 27 is closer to a horizontal plane HP, in which the rotational axis 25*a* of the pressure roller 25 lies, than the downstream end of the guide 27. More specifically, the separator 27*a* of the guide 27 is closer to the horizontal plane HP, where a rotational axis 25*a* lies, than the top Q2 of the guide 27. In other words, a height H2 is greater than a height H1.

The guide 29 includes a wall 29*e* having a round corner 29*a* at an upper end portion closer to the route selector 102 and a round corner 29*b* at an upper end portion closer to the fixing section 9, so that the round corners 29*a* and 29*b* form a guide surface 29*d* (FIG. 6) which is a convex surface as a whole. The guide surface 29*d* faces the lower side of the medium P when the medium P is transported. The wall 29*e* extends higher than a guide surface 100*a* of the guide 100 disposed downstream of the guide 27.

Figure 5A:
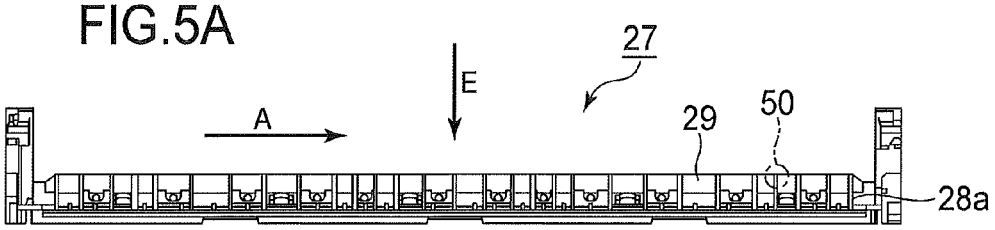
FIG. 5A is a front view of the guide as seen in a direction shown by arrow B of FIG. 1.
Figure 5B:
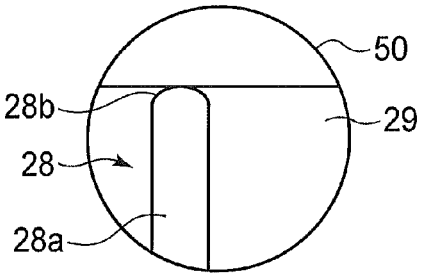
FIG. 5B is an enlarged view of a portion depicted at 50 shown in FIG. 5A.

FIG. 5A is a front view of the guide 27 as seen in the B direction of FIG. 3. FIG. 5B is an enlarged view of a portion depicted at 50 shown in FIG. 5A. Referring to FIG. 5B, the guide surface 28*a* has round corners 28*b* as second round corners with a convex surface that faces the lower side of the medium P when the medium P slides upwards on the guide surface 28*a*. In other words, the round corners 28*b* have a convex surface sloping downwardly from the guide surface 28*a*. A flat surface 28*c* and the convex or curved surfaces of the round corners 28*b* constitute the guide surface 28*a* as a first guide surface.

Figure 6A:
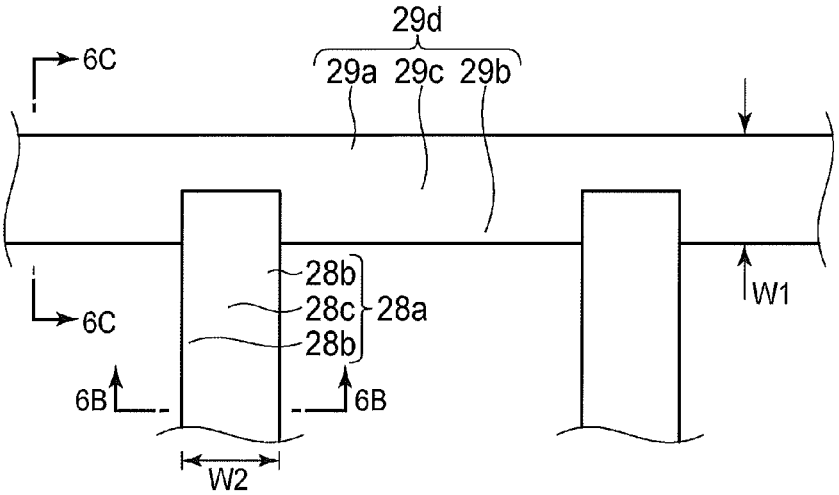
FIG. 6A is a partial front view of the guide rib and guide rib as seen in a direction shown by arrow E in FIG. 5A.
Figure 6B:
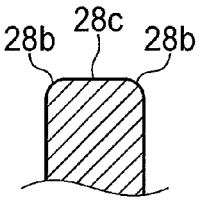
FIG. 6B is a cross-sectional view taken along a line 6B-6B in FIG. 6A.
Figure 6C:
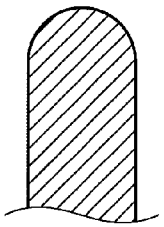
FIG. 6C is a cross-sectional view taken along a line 6C-6C in FIG. 6A.

FIG. 6A is a partial front view of the guide rib 28 and guide rib 29 as seen in a direction shown by arrow E in FIG. 5A. FIG. 6B is a cross-sectional view taken along a line 6B-6B in FIG. 6A. FIG. 6C is a cross-sectional view taken along a line 6C-6C in FIG. 6A.

As shown in FIG. 6A, the guide surface 28*a* includes the flat surface 28*c* contiguous to the round corners 28*b* that extend substantially parallel to the B direction. The guide surface 28*a* is a surface on which the medium P slides upward when the medium P is discharged from the fixing section 9 toward the guide 100.

As described above, the guide surface 29*d* includes the round corners 29*a* and 29*b* smoothly contiguous with each other at their boundary which is the top or a ridge 29*c* of the guide surface 29*d*. In other words, the round corners 29*a* and 29*b* have a convex or curved surface sloping downwardly from the boundary. The medium P slides on the boundary 29*c* when the medium P slides upward on the guide 27. The guide rib 29 has a width W1 and the guide rib 28 has a width W2, W1 being larger than W2.

FIG. 7 illustrates the positional relation between the guide 27 and the route selector 102 that forms the simplex path through which the medium P is discharged to the stacker 13. A step 120 between the guide surface 29*d* (or top Q2) and an upstream end of the guide surface 100*a*. A second guide 110 includes the guide surface 100*a* of the guide 100 and the guide surface 101*a* of the router 101. The guide surface 100*a* and the guide surface 101*a* cooperate with each other to guide the medium P.

The step 120 is defined so that the second guide 110 is spaced apart from a plane PL1 in which an upstream end Q1 of a nip formed at the transport roller pair 191 and a top Q2 of the guide 27 lie or the second guide 110 is lower than the plane PL1. It is to be noted that the downstream end of the first guide 27 is above the upstream end of the second guide 110.

The step 120 is effective in preventing the leading edge of the medium P from interfering with part of the second guide 110.

Figure 8:
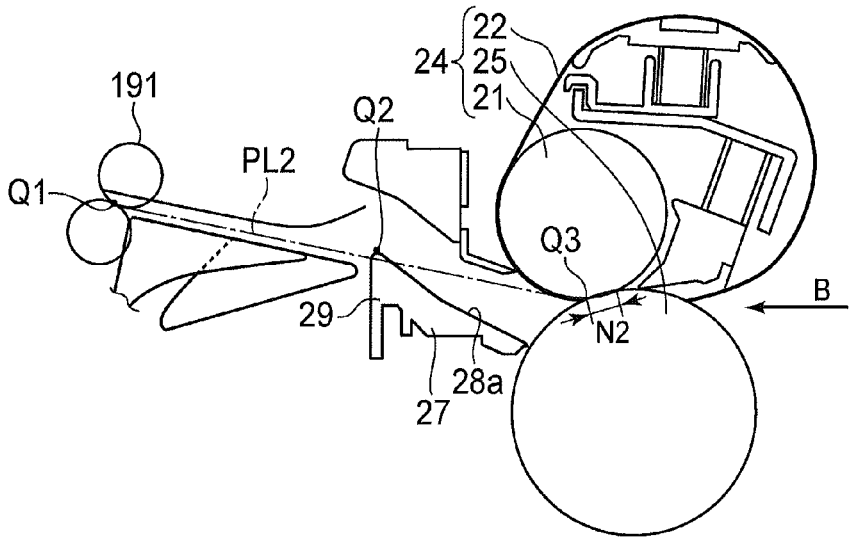
FIG. 8 is a cross-sectional view illustrating the configuration of the fixing section, showing the positional relation between the guide and plane PL2.

The top Q2 is at the boundary between round corners 29*a* and 29*b* or the ridge 29*c* of the guide rib 29. The guide surface 28*a* is inclined such that an upstream end of the guide surface 28*a* is farther away from the plane PL1 than a downstream end of the guide surface 28*a*. Referring to FIG. 8, the downstream end of the top Q2 of the guide 27 extends upward through a plane PL2 that passes through a downstream end Q3 of the nip N1 and the upstream end Q1 of the nip formed at the transport roller pair 191.

The guide surface 28*a* is inclined with respect to the plane PL2 such that the guide surface 28*a* is closer to the plane PL2 nearer the top Q2. The distance between the upstream end Q1 and the top Q2 and the distance between the downstream end Q3 of the nip N2 and the upstream end Q1 are shorter than the length of the medium P in the B direction. The printer 1 having the aforementioned configuration includes a controller in the form of, for example, a central processing unit (CPU). The controller executes a control program stored in a memory or the like, thereby controlling the overall operation of the printer 1.

The operation of the printer 1 with the aforementioned configuration will be described.

Figure 9:
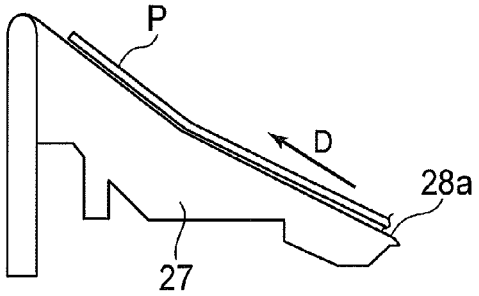
FIG. 9 illustrates the medium P sliding on the guide surface.

FIG. 8 is a cross-sectional view illustrating the configuration of the fixing section, showing the positional relation between the guide and plane PL2. FIG. 9 illustrates the medium P sliding on the guide surface.

The printing operation of the printer 1 will be described with reference to FIGS. 1 and 2. When the fixing roller 21 (FIG. 2) rotates, the fixing roller 21 causes the fixing belt 22 to revolve in the C direction in contact with a planar heater 23 and electric power is supplied to a heater driver 23*a*, so that a heat generating element 23*b* generates heat, which in turn heats the fixing belt 22. The temperature detector 31 detects the temperature of the surface of the fixing belt 22, and the controller controls the electric power supplied to the heater driver 23*a*, thereby maintaining the surface of the fixing belt 22 to a predetermined temperature.

The pick-up roller 2 feeds the medium P from the cassette 3, and the feed roller 17*a* and the retard roller 17*b* cooperate with each other to feed only the top sheet at a time to the transport roller pair 198. The medium P is then advanced to the registry roller 5. The medium P is then fed by the registry roller 5 to the transfer belt 6. As the medium P passes through a transfer point defined between the print engine 7 and the transfer belt 6, the transfer roller 18 transfers the toner image 26 from the print engine 7 onto the medium P.

Referring to FIG. 3, the medium P having the toner image 26 thereon passes through the nip N1 and then the nip N2, so that the toner image 26 is fixed by heat and pressure. The medium P is transported to the guide 27 downstream of the nips N1 and N2, while being sandwiched between the fixing belt 21 and the pressure roller 25.

Once the medium P arrives at the guide 27, the medium P starts to slide on the guide surface 28*a* of the guide rib 28 upwardly in a direction shown by arrow D (FIG. 9). Since, the guide surface 28*a* is inclined relative to the plane PL2 so that the guide surface 28*a* is closer to the place PL2 nearer the guide surface 100*a* of the guide 100, the medium P is guided to the guide surface 28*a* without difficulty. It is to be noted that the guide surface 28*a* extends generally in the transport direction of the medium P and has the round corners 28*b* and therefore guides the medium P smoothly without rubbing the medium P significantly.

When the leading edge portion of the medium P is pulled in between the transport roller pair 191, the upstream portion of the medium P sits on the guide surface 29*d* of the guide rib 29 shown in FIGS. 5 and 6. The guide surface 29*d* extends in the A direction and has the larger width W1 than the guide surface 28*a*, thus significantly contributing in supporting the weight of the medium P. Therefore, the pressing force of the medium P exerted on the guide 27 is resolved both in the B direction in which the medium P is transported and in the A direction substantially perpendicular to the B direction. This alleviates the weight of the medium P exerted on the guide surface 28*a* significantly. In addition, the guide rib 29 has the round corner 29*a* as shown in FIGS. 4 and 6, and therefore the medium P does not become scratched by the guide 27.

The upstream end of the guide 110 is lower than the downstream end of the guide 27 or the plane PL1 as shown in FIG. 7, creating the step 120. Thus, when the medium P is being transported by the transport roller pair 191, the step 120 is effective in allowing the medium P to gently slide on the guide rib 29 so that the medium P exerts a minimum pressing force on the guide surface 29*d*.

Referring to FIG. 8, the top Q2 of the guide rib 29 upwardly extends through the plane PL2. Therefore, the medium P may be in contact with the guide rib 29 in a reliable manner even when the medium P is held in a sandwiched relation by both the first transport section 24 and the transport roller pair 191. This is effective in maintaining the medium P under a reduced contact pressure of the guide rib 29.

As shown in FIG. 4, if the medium is relatively pliable, as soon as the trailing end portion of a the medium P arrives at the top Q2, slack is formed in the trailing end portion of the medium P and therefore the trailing end portion smoothly slides down from the top Q2 while leaning against the upper portion of the wall 29*b*. Thus, the trailing end of the medium will not contact the guide rib 29 again. In this manner, the medium p passes the guide 27 and the guide 110 and is then transported further by the transport roller pair 191 and through the discharge roller pair 192 onto the stacker 13.

As described above, the invention according to the first embodiment employs the guide ribs 28 that slope upward from upstream to downstream in directions generally parallel to the direction in which the medium P is transported, and the guide rib 29 that is located downstream end of the guide ribs 28*b* and that extends in the A direction. This configuration minimizes the chance of the medium P being rubbed against the guide 27 while the medium P is transported. This is very effective especially when duplex printing is performed because the toner image fixed on the lower side of the medium P is rubbed by the guide 27.

In the first embodiment, the round corners 28*b* have a radius of curvature of 0.5 mm. Instead, the radius of curvature may be in the range of 0.2 to 0.8 mm and still provides the equivalent effects to the radius of curvature of 0.5 mm. In addition, the round corners 29*a* and 29*b* have a radius of curvature of 1.0 mm. Instead, the radius of curvature of the round corners 29*a* and 29*b* may be in the range of 0.5 to 1.5 mm and still provides the equivalent effects to the radius of curvature of 1.0 mm.

Second Embodiment

In the first embodiment, the combination of the guide ribs 28 and the guide rib 29 can suffer from a drawback in that a small amount of moisture in the medium P vaporizes and water droplets adhere to the guide ribs damaging the image on the medium P. This type of drawback is apt to occur if a guide is located downstream of a nip formed in a fixing section 9 in which a toner image is fixed.

Figure 10:
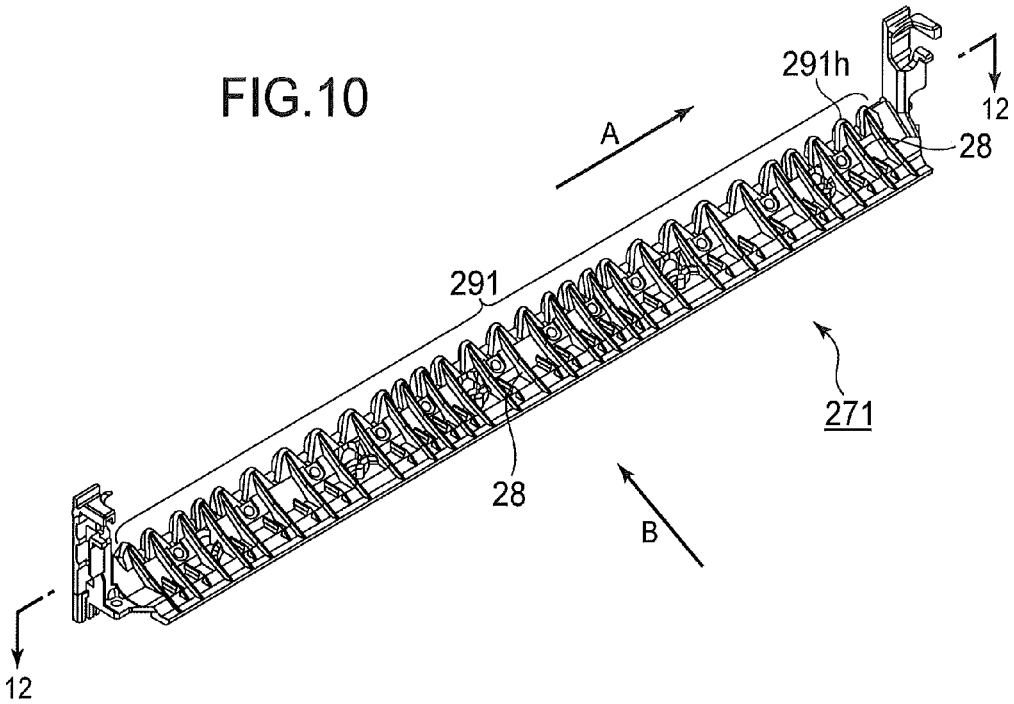
FIG. 10 is a perspective view of a guide according to a second embodiment.
Figure 11A:
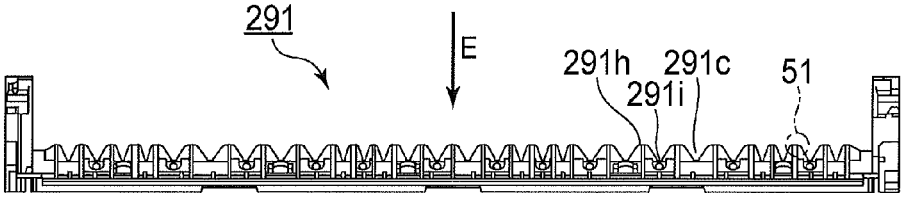
FIG. 11A is a front view of the guide.
Figure 11B:
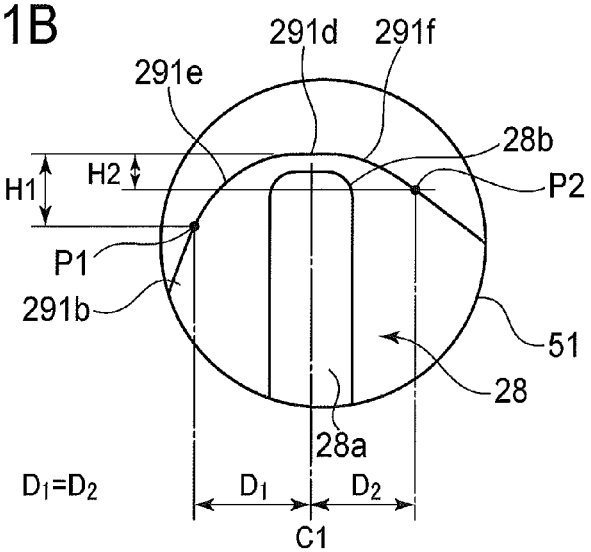
FIG. 11B is an enlarged view of a portion depicted at 51 in FIG. 11A.
Figure 12:
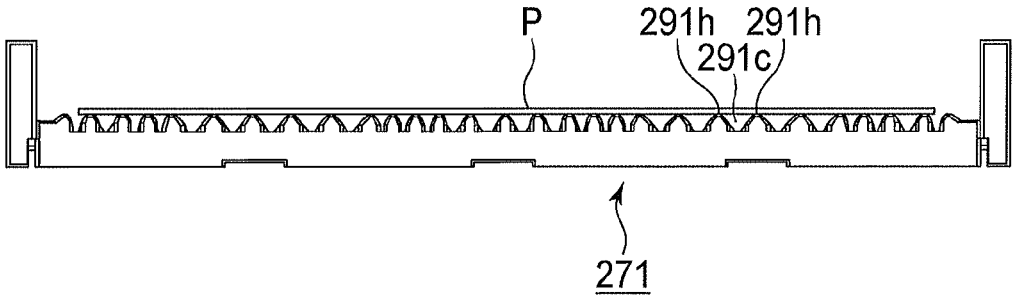
FIG. 12 is a cross-sectional view taken along a line 12-12 in FIG. 10.
Figure 14:
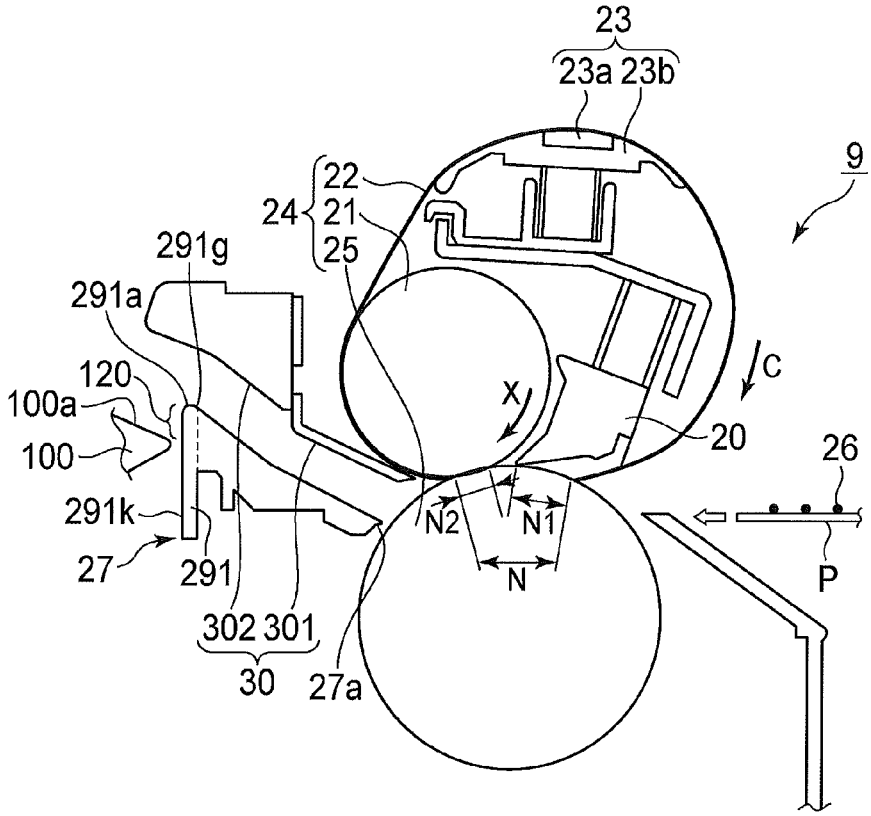
FIG. 14 is a cross-sectional view illustrating the configuration of the fixing secion according to the second embodiment.

FIG. 10 is a perspective view of a guide according to a second embodiment. FIG. 11A is a front view of the guide. FIG. 11B is an enlarged view of a portion depicted at 51 in FIG. 11A. FIG. 12 is a cross-sectional view taken along a line 12-12 in FIG. 10. FIG. 14 is a cross-sectional view illustrating the configuration of the fixing section 9 according to the second embodiment. Elements in FIGS. 10-12 similar to those in the first embodiment have been given references similar to those of the first embodiment. The second embodiment differs from the first embodiment in that a guide 271 has a guide rib 291 whose shape is different from the guide 29 of the first forst embodiment.

The guide rib 291 includes a row of ridges 291*h* and furrows 291*i* disposed at downstream ends of the guide ribs 28, the row extending in a direction shown by arrow A substantially perpendicular to a direction shown by arrow B in which a medium P is transported. The term "substantially perpendicular" covers angles in the range of 85-95 degrees. The ridges 291*h* and furrows 291*i* are alternately disposed, so that each ridge 291*h* is at the downstream end of a corresponding guide rib 28 and each furrow 291*i* is between adjacent guide ribs 28. The ridges 291*h* and furrows 291*i* are aligned at close intervals at the longitudinal middle portion of the guide 271 and at the longitudinal end portions so that a medium having a smaller width is supported and guided by the ridges 291*h* and furrows 291*i* at the longitudinal middle portion and a medium having a larger width is supported and guided by the all the ridges 291 and furrows 291*i*. The ridges 291*h* and furrows 291*i* located between those at the longitudinally middle portion and at the longitudinally end portions are aligned at larger intervals than those at the longitudinal middle portion and at the longitudinal end portions. Thus, when a medium having a smaller width is transported, there is less chance of the widthwise edges of the medium of being caught by the ridges 291*h* and furrows 291*i* aligned at the larger intervals. The ridge 291*h* and furrow 291*i* define a cutout 291*c* therebetween.

The ridge 291*h* has a flat top portion 291*d*, curved portions or round corners 291*f* and 291*e* that gradually slope down towards furrows 291*i* adjacent to the ridge 291*h*. The curved portions 291*e* and 291*f* extend in directions perpendicular to the B direction. The ridge 291 is asymmetric with respect to a centerline CL. A trailing end point P1 is at a distance D1 from the center line CL and a trailing end point P2 is at a distance D2 from the center line CL. The distances D1 and D2 are equal.

Figure 13A:
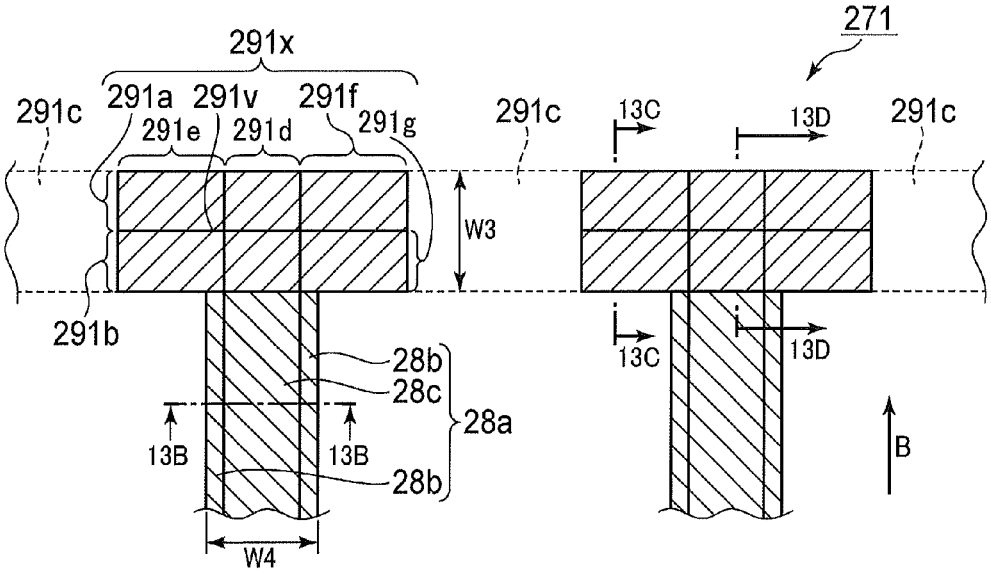
FIG. 13A is a partial top view of the guide rib and guide rib as seen in a direction shown by arrow E of FIG. 11A.
Figure 13B:
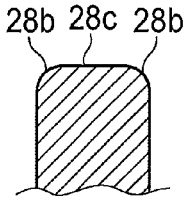
FIG. 13B is a cross-sectional view taken along a line 13B-13B in FIG. 13A.
Figure 13C:
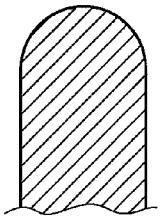
FIG. 13C is a cross-sectional view taken along a line 13C-13C in FIG. 13A.
Figure 13D:
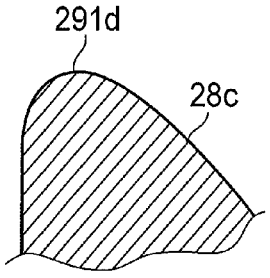
FIG. 13D is a cross-sectional view taken along a line 13D-13D in FIG. 13A.

FIG. 13A is a partial top view of the guide rib 28 and guide rib 291 as seen in a direction shown by arrow E of FIG. 11A. FIG. 13B is a cross-sectional view taken along a line 13B-13B in FIG. 13A. FIG. 13C is a cross-sectional view taken along a line 13C-13C in FIG. 13A. FIG. 13D is a cross-sectional view taken along a line 13D-13D in FIG. 13A.

The guide 271 includes a guide surface 28*a* on which the medium P slides when the medium P is transported along the guide rib 28. The guide surface 28*a* includes round corners 28*b* and a flat portion 28*c* between and contiguous with the round corners 28*b*.

When the medium P is transported, the medium P slides on a guide surface 291*x* as a second guide surface. The guide surface 291*x* includes a boundary 291*v*, a flat top portion 291*d*, round corners 291*a* and 291*b*, and round corners 291*e* and 291*f*. The round corners 291*a* and 291*b* are smoothly contiguous with each other at the top boundary 291*v*, the round corner 291*a* facing downstream and the round corner 291*b* facing upstream. The round corners 291*a* and 291*b* have a convex surface sloping downwardly from the top boundary 291*v*. Likewise, the round corners 291*g* and 291*j* have a convex surface sloping downwardly from the top boundary 291*v*. The flat top portion 291*d* is between the round corners 291*e* and 291*f* and is contiguous with the round corners 291*e* and 291*f*. As is clear from FIG. 13A, the dimension W3 of the guide surface 291*x* in the A direction is larger than the dimension W4 of the first guide surface 28*a* in the A direction.

The round corners 291*e* and 291*f* have a larger radius than the round corner 28*b* of the second guide 28, and have a convex surface sloping downwardly from the flat top portion 291*d*. The ridge 291*h* and furrow 291*a* have a round corner 291*g* facing upstream and a round corner 291*a* facing downstream. Just as in the first embodiment, the guide rib 28 is inclined so that when the medium P is transported, the medium P slides upward on the first guide surface 28*a*. The guide rib 291 of the guide 271 includes a wall 291*k* at the most downstream end portion of the guide 271, facing the guide surface 100*a* and higher than the guide surface 100*a* as shown in FIG. 14.

The operation of the aforementioned configuration will be described with reference to FIGS. 11-15.

Figure 15:
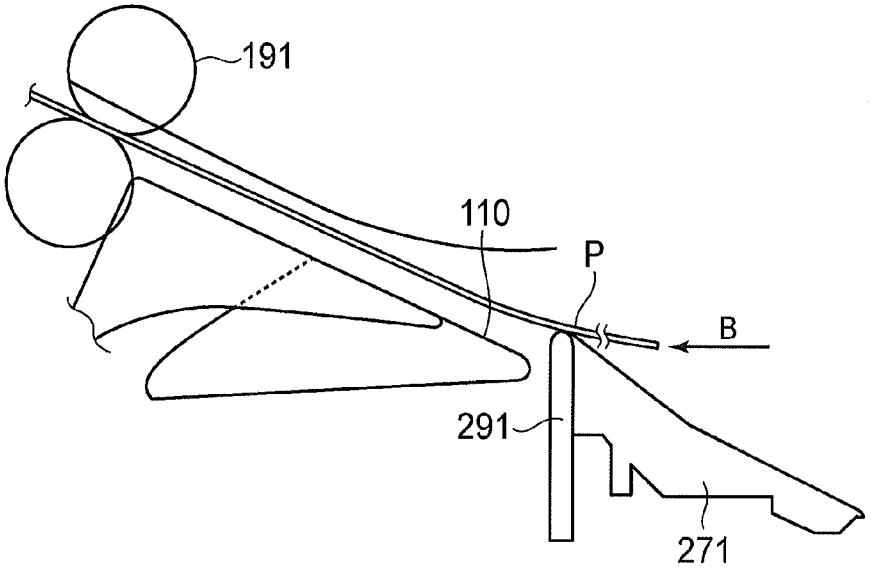
FIG. 15 illustrates the medium being transported past the guides.

FIG. 15 illustrates the medium being transported past the guides.

Referring to FIG. 14, after the printer is turned on, the printer starts printing and a toner image is transferred onto the medium P. The medium P passes through the nips N 1 and N2, advancing to the guide 271.

With reference to FIGS. 11-14, a description will be given of the operation of the aforementioned configuration when the medium P is guided by the guide 271. When the medium P is guided by the guide 271, the medium P slides on the ridges 291*h*, so that openings 291*c* are defined by the medium P, ridges 291*h*, and furrows 291*i* as shown in FIG. 12.

This configuration is effective in escaping vaporized moisture released from the medium P when heated by the fixing section 9. The vaporized moisture escapes through the openings 291*c* to the outside of the guide 271. The configuration prevents condensation of the vaporized moisture from forming, thereby minimizing the chance of the toner images being deteriorated.

Thus, as shown in FIG. 15, when the leading end of the medium P is advanced past the downstream end of the guide 271 and is then held by the transport roller pair 191, the medium P is transported with the lower side of the medium P in contact with the second guide surface 291*x* of the guide 291. Therefore, the gravity force of the medium P exerted on the guide 271 is supported by a row of guide surfaces 291*x* extending in the A direction perpendicular to the B direction, thereby allowing the weight of the medium P to be distributed along the row. Hence, the chance of the medium P of being rubbed by the guide 271 is minimized.

Since a plurality of ridges 291*h* are aligned in the A direction substantially perpendicular to the B direction, each ridge 291*h* supports a small fraction of the weight of the medium P while maintaining the opening 291*c*. It is preferable that at least three ridges 291*h* are disposed in an area through which the medium P passes. In addition, the round corner 291*g* on the upstream side and the round corner 291*a* on the downstream side eliminate the chance of the medium P becoming scratched on the guide 271 as shown in FIG. 14.

The diameter of the round corners 291*e* and 291*f* larger than that of the round corners 28*b* reduces, even when the medium P contacts the guide surface 291*x* under a relatively large pressing force, the rubbing of the medium P against the boundary between the flat top portion 291*d* and the round corners 291*e* and 291*f* of the second guide surface 291*x*. In the second embodiment, the round corners 291*a* and 291*g* have a radius of curvature of 1.0 mm, but are not limited to this. Equivalent effects may be obtained as long as the round corners 291*a* and 291*g* have a radius of curvature in the range of 0.5 to 1.5 mm.

Although the round corners 291*e* and 291*f* have a radius of curvature of 2.0 mm in the second embodiment, the radius is not limited to this. Equivalent effects may be obtained as long as the radius is in the range of 1.0 to 3.0 mm. The difference in height, H1, between the trailing end portion P1 (FIG. 11B) of the round corner 291*e* and the flat top portion 291*d* is equal to or larger than 0.7 mm. However, the difference in height, H2, between the trailing end portion P2 (FIG. 11B) of the round corner 291*f* and the flat top portion 291*d* is equal to or larger than 0.7 mm. The differences in height, H1 and H2, are not limited to this. Equivalent effects may be obtained as long as the differences in height, H1 and H2, are equal to or larger than 0.5 mm.

In the second embodiment, ridges and furrows are disposed alternately with each other in the A direction substantially perpendicular to the B direction, so that openings are defined between the medium P, the ridges, and the furrows. This configuration provides additional effects in that condensation is prevented from forming, in addition to the effects of the first embodiment. While the image forming apparatus in the first and second embodiments have been described in terms of a printer, the image forming apparatus is not limited to a printer but may be in the form of a facsimile machine, a copying machine, or a multi function peripheral (MFP).

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A medium transporting apparatus, comprising:

a first transporting section that transports a medium;

a first guide for guiding the medium transported by the first transporting section, the first guide being disposed downstream of the first transporting section in a first direction in which the medium is transported; and a second transporting section disposed downstream of the first guide in the first direction;

wherein the first guide includes a first guide portion that extends in the first direction, and a second guide portion that extends in a second direction substantially perpendicular to the first direction;

wherein the first guide includes a first guide surface on which the medium is transported;

wherein the first guide surface is inclined so that the first guide surface slopes upward from upstream to downstream along the first direction;

wherein when a first straight line is defined as an imaginary straight line connecting a downstream end of a first nip portion formed by the first transporting section for transporting the medium and an upstream end of a second nip portion formed by the second transporting section for transporting the medium, the second guide portion is disposed so as to protrude from the first straight line at a downstream end of the first guide portion in the first direction.

2. The medium transporting apparatus according to claim 1, further comprising a second guide disposed downstream of the first guide in the first direction.

3. The medium transporting apparatus according to claim 1, wherein when a downstream part of the medium is transported by the second transporting section, an upstream part of the medium contacts the second guide portion.

4. The medium transporting apparatus according to claim 2, wherein the second transporting section is disposed downstream of the second guide in the first direction;

wherein the first guide and the second guide are disposed so that the first guide and the second guide define a stepped portion therebetween; and wherein the first guide includes a downstream end and the second guide includes an upstream end, the downstream end of the first guide being above the upstream end of the second guide.

5. The medium transporting apparatus according to claim 2, wherein the first guide and the second guide are positioned so that the first guide and the second guide define a stepped portion therebetween; and wherein the second guide includes a third guide portion spaced by a distance from the first guide.

6. The medium transporting apparatus according to claim 1, wherein the first guide includes a wall that faces the second guide.

7. The medium transporting apparatus according to claim 2, wherein the second guide portion includes a round corner with a curved surface that slopes downward from upstream to downstream and faces the second guide.

8. The medium transporting apparatus according to claim 7, wherein the round corner is a first round corner; and wherein the first guide portion includes a flat surface and a second round corner with a curved surface sloping downward from the flat surface.

9. The medium transporting apparatus according to claim 1, wherein the second guide portion includes a plurality of cutouts aligned in the second direction.

10. The medium transporting apparatus according to claim 9, wherein at least one second guide surface is defined between adjacent cutouts; and wherein the first guide portion has a first dimension in the second direction, and the second guide portion has a second dimension in the first direction, the second dimension being larger than the first dimension.

11. The medium transporting apparatus according to claim 1, wherein the second guide portion includes ridges and furrows disposed alternately so that each furrow is positioned between adjacent ridges.

12. The medium transporting apparatus according to claim 10, wherein the at least one second guide surface includes a curved surface sloping downward in a direction substantially perpendicular to the first direction.

13. A medium transporting apparatus, comprising:

a first transporting section that transports a medium; and a first guide for guiding the medium transported by the first transporting section, the first guide being disposed downstream of the first transporting section in a first direction in which the medium is transported;

wherein the first guide includes a first guide portion that extends in the first direction, and a second guide portion that extends in a second direction substantially perpendicular to the first direction;

wherein the second guide portion includes a plurality of cutouts aligned in the second direction;

wherein the first guide includes a first guide surface on which the medium is transported;

wherein at least one second guide surface is defined between adjacent cutouts;

wherein the first guide portion has a first dimension in the second direction, and the second guide portion has a second dimension in the first direction, the second dimension being larger than the first dimension;

wherein the first guide portion includes a first round corner with a first curved surface sloping downward from the first guide surface; and wherein the at least one second guide surface includes a flat top surface and the second guide portion includes a second round corner with a second curved surface, the second curved surface being contiguous with the flat top surface and sloping downward from the flat top surface, the second curved surface having a larger radius of curvature than the first curved surface of the first round corner.

14. An image forming apparatus incorporating a medium transporting apparatus according to claim 1.

15. The image forming apparatus according to claim 14, further comprising:

a developing section for forming a developer image;

a transferring section for transferring the developer image onto a medium; and a fixing section for fixing the developer image on the medium;

wherein the fixing section includes the first transporting section.

16. A medium transporting apparatus, comprising:

a first transporting section that transports a medium;

a first guide for guiding the medium transported by the first transporting section, the first guide being disposed downstream of the first transporting section in a first direction in which the medium is transported;

wherein the first guide includes a first guide rib protruding from a base portion and extending in the first direction, and a second guide rib protruding from the base portion and extending in a second direction substantially perpendicular to the first direction;

wherein a guide surface of the first guide rib and a guide surface of the second guide rib are aligned on a same plane at an end portion of the first guide in the first direction;

wherein the second guide rib includes a plurality of ridges and furrows formed by upward inclinations and downward inclinations in the second direction;

wherein the plurality of ridges and furrows are disposed alternately so that each furrow is positioned between adjacent ridges;

wherein a plurality of the first guide ribs are arranged in the second direction; and wherein at least one furrow is disposed between every two adjacent first guide ribs.

* * * * *